US006842403B2

(12) United States Patent
Meis

(10) Patent No.: US 6,842,403 B2
(45) Date of Patent: Jan. 11, 2005

(54) CHRONOGRAPH

(75) Inventor: Reinhard Meis, Stockach (DE)

(73) Assignee: Lange Uhren GmbH, Glashuette (DE)

( * ) Notice: Subject to any disclaimer, the term of this patent is extended or adjusted under 35 U.S.C. 154(b) by 0 days.

(21) Appl. No.: 10/380,815

(22) PCT Filed: Jul. 25, 2002

(86) PCT No.: PCT/IB02/02435

§ 371 (c)(1),
(2), (4) Date: Mar. 18, 2003

(87) PCT Pub. No.: WO03/009068

PCT Pub. Date: Jan. 30, 2003

(65) Prior Publication Data

US 2004/0037171 A1 Feb. 26, 2004

(30) Foreign Application Priority Data

Jul. 19, 2001 (DE) ..... 101 35 110

(51) Int. Cl.[7] ..... G04F 10/00
(52) U.S. Cl. ..... 368/110; 368/106
(58) Field of Search ..... 368/105–106, 368/140, 185, 76, 80, 157, 160

(56) References Cited

U.S. PATENT DOCUMENTS 4,588,305 A * 5/1986 Piguet et al. ..... 368/185
4,681,464 A * 7/1987 Ray ..... 368/157
5,793,708 A * 8/1998 Schmidt et al. ..... 368/106
6,428,201 B1 * 8/2002 Shibuya et al. ..... 368/106

FOREIGN PATENT DOCUMENTS

| | | | |
|---|---|---|---|
| CH | 682201 | 8/1993 | ..... G04F/7/08 |
| DE | 42 09 580 | 9/1993 | ..... G04F/7/08 |

* cited by examiner

*Primary Examiner*—Kamand Cuneo
*Assistant Examiner*—Thanh S. Phan
(74) *Attorney, Agent, or Firm*—Cohen, Pontani, Lieberman & Pavane

(57) ABSTRACT

The invention relates to a chronograph having a chronograph drive by means of which, when a first actuating element is actuated manually, a chronograph-hand stem of a chronograph hand can be driven in rotation, and having a rattrapante-hand stem, coaxial with the chronograph-hand stem, of a rattrapante hand which can be driven in an overlapping manner with the chronograph hand. A seconds heart cam for resetting the chronograph hand is arranged on the chronograph-hand stem, and the chronograph-hand stem and rattrapante-hand stem are connected to one another in a rotationally fixed manner by a rattrapante heart cam of a force-fitting coupling. A rattrapante wheel 6 is arranged on the rattrapante-hand stem, can be encompassed under spring prestressing by the gripper arms of a rattrapante gripper and can be blocked against rotation by a friection or form fit. A switching element which can be moved, by manual actuation of a second actuating element, between a blocking position and an unblocking position and by means of which the gripper arms can be lifted off from the rattrapante wheel, out of their rotation-blocking position.

20 Claims, 5 Drawing Sheets

CHRONOGRAPH

PRIORITY CLAIM

This is a U.S. national stage of application No. PCT/IB02/02435, filed on 25 Jul. 2002. Priority is claimed on that application and on the following application: Country: Germany, Application No.: 101 35 110.0, Filed: 19 Jul. 2001.

BACKGROUND OF THE INVENTION

1. Field of the Invention

The invention relates to a chronograph having a chronograph drive by means of which, when a first actuating element is actuated manually, a chronograph-hand stem of a chronograph hand stem of a chronograph hand can be driven in rotation. A rattrapante-hand stem, coaxial with the chronograph-hand stem, of a rattrapante hand can be driven in an overlapping manner with the chronograph hand, a seconds heart cam for resetting the chronograph hand being arranged on the chronograph-hand stem. The chronograph-hand stem and rattrapante-hand stem can be connected to one another in a rotationally fixed manner by a rattrapante hear cam of a force-fitting coupling. A rattrapante wheel arranged on the rattrapante-hand stem can be encompassed under striping prestressing by the gripper arms of a rattrapante gripper and can be blocked against rotation by a friction or form fit. A switching element can be moved by manual actuation of a second actuating element between a blocking position and an unblocking position and by means of which the gripper arms can be lifted off from the rattrapante wheel, out of their rotation-blocking position.

2. Description of the Related Art

Such a chronograph is known from DE 42 09 580 C2. It is possible in the case of this known chronograph, following start-up, by actuation of the first actuating element, for the chronograph hand and the rattrapante hand to be stopped again together. It is also possible, by means of the second actuating element, to stop just the rattrapante hand, while the chronograph hand continues running. It is thus possible to measure time intervals within a minute. If the second actuating element is actuated again, the rattrapante hand jumps to the position of the continuing chronograph hand and continues running therewith, and is ready for a further time interval to be measured anew. The measurement of time intervals can be repeated as often as desired. If it is also desired to stop the chronograph hand, the first actuating element has to be actuated again. There are thus two states for the stationary hands. Either the two hands are located one above the other or each hand has a dedicated position.

SUMMARY OF THE INVENTION

The object of the invention is to provide a chronograph of the type mentioned in the introduction in the case of which, with straightforward actuation, immediate zeroing is possible in each case from the position in which the chronograph hand and rattrapante hand are located one above the other, from respectively dedicated positions of these two hands and from the state in which these hands are moving, and, in the case of zeroing from the moving state, immediate restarting (flyback) is also possible.

This object is achieved according to the invention in that by means of a third actuating element, as a result of the latter being moved manually from its non-active position into its active position, the chronograph-hand stem and chronograph hand can be moved into their zero position and the switching element located in its blocking position can be moved into its unblocking position or the switching element located in its unblocking position remains in its unblocking position.

By means of the single actuation of the third actuating element alone, the stationary or moving hands can be set to their zero position without an actuating-element actuation thus having to be carried out in each case for stopping purposes and then for zeroing purposes and, if appropriate a third time, for restarting purposes. All that is required for this restarting is for the actuated third actuating element to be released, with the result that this restarting can take place in a delay-free manner following the zeroing operation.

A straightforward construction of the multiple function is achieved in that the third actuating element can actuate an adjusting device by means of which the switching element can be driven to move between its blocking position and its unblocking position, it being possible, by means of a contact element, to gage the position of the switching element and, in the unblocking position of the switching element, to deactivate the adjusting device and, in the blocking position of the switching element, to activate the adjusting device.

It is possible, for this purpose, for the adjusting device to have a switching wheel which is connected in a coaxially rotationally fixed manner to the switching element or can be driven in rotation via an intermediate gear mechanism and can be advanced, by means of a switching nose which can be actuated by the third actuating element, by a switching step which corresponds to a switching step of the switching element from the blocking position into the unblocking position.

In order to ensure that the switching element located in its unblocking position remains in this unblocking position, it is possible, in the unblocking position of the switching element, for the adjusting device to be disengaged from the switching wheel.

The switching element may be designed in different ways and, depending on the design, can be advanced in one direction of rotation or in an alternating direction of rotation.

A straightforward design of the switching wheel and of the adjusting device consists in that the switching wheel is a sawtooth wheel or a cam wheel which can be advanced by an adjusting-device switching nose which is designed as a pawl and in the blocking position of the switching element can be brought into engagement with, and in the unblocking position of the switching element can be disengaged from, the sawtooth wheel or cam wheel.

A likewise straightforward design of the switching element consists in that the switching element is a column wheel with alternately radially projecting columns and valleys of relatively short radial extent, a contact element being movable in the radial direction and, depending on the position of the column wheel, coming into abutment against the end side of a column or projecting into a valley.

The adjusting device here, preferably designed with only a small number of components, has a lever which can be pivoted about a pivot pin, parallel to the axes of rotation of the column wheel and of the sawtooth wheel or cam wheel, can be moved, by means of the third actuating element, in the direction of its longitudinal extent, approximately tangentially to the sawtooth wheel or cam wheel, and has the pawl at its free end, it being possible for the lever, by means of the column of the column wheel, to be pivoted out of engagement from the sawtooth wheel or cam wheel by way of its pawl.

It is likewise possible, in a straightforward design, for the column to act on a contact element of the lever, which is designed as a contact nose.

In order to prevent the switching element and/or the switching wheel from being switched accidentally, the switching element and/or switching wheel can be arrested in the blocking position or the unblocking position by means of a latching spring, for which purpose the latching spring can easily be latched into the gaps between the teeth of the switching wheel, which is designed as a gearwheel.

A straightforward design is likewise achieved if the gripper arms have contact cams which are directed radially in relation to the axis of rotation of the column wheel and, depending on the position of the column wheel, butt against the end side of a column or project into a valley.

In order to assist delay-free restarting following actuation of the third actuating element, it is possible for the third actuating element to be forced by a spring into its non-active position.

The rattrapante wheel is preferably the rattrapante wheel of a rattrapante seconds counter.

In order to allow a second rattrapante hand, which is preferably the rattrapante hand of a minutes counter, it is possible by means of a chronograph drive, when the first actuating element is actuated manually, for a second hand stem of a second chronograph hand to be capable of being driven in rotation, having a second rattrapante-hand stem, coaxial with the second hand stem, of a second rattrapante hand which can be driven in an overlapping manner with the second chronograph hand, a minutes-counter heart cam for resetting the second chronograph hand being arranged on the second hand stem, and it being possible for the second hand stem and the second rattrapante-hand stem to be connected to one another in a rotationally fixed manner by a second rattrapante heart cam of a force-fitting coupling, having a second rattrapante wheel which is arranged on the second rattrapante-hand stem, can be encompassed under spring prestressing by gripper arms of a second rattrapante gripper and can be blocked against rotation by a friction or form fit, it being possible, by means of the switching element, for the gripper arms of the second rattrapante gripper to be lifted off from the second rattrapante wheel, out of their rotation-blocking position, and it being possible, as a result of the third actuating element being moved manually from its non-active position into its active position, for the second hand stem and the second chronograph hand and for the second rattrapante-hand stem and the second rattrapante hand to be moved into their zero position.

It is possible here for the second rattrapante wheel to be the rattrapante wheel of a minutes counter and for the second rattrapante hand to be a rattrapante minutes counter.

Space is saved and the chronograph is simplified if the first chronograph-hand stem and the second hand stem can be driven in rotation by a common chronograph drive.

The switching element can preferably actuate an actuating device by means of which the gripper arms of the second rattrapante gripper can be lifted-off from the second rattrapante wheel, out of their rotation-blocking position.

In a straightforward design, it is possible here for the actuating device to have a two-armed lever which can be pivoted about a pivot pin, a contact nose being arranged at the end of one lever arm of said lever and being able to gage the position of the switching element, and it being possible for the end of the second lever arm of said lever, when the rotation-blocking position of the switching element has been sensed, to actuate a second switching element for lifting off the gripper arms of the second rattrapante gripper from the second rattrapante wheel.

The second switching element is of particularly straightforward design here if the second switching element is a ramp element which can be moved, by means of the second lever arm, approximately in the longitudinal extent of the gripper arms of the second rattrapante gripper and by means of which the gripper arms of the second rattrapante gripper can be spread apart from one another.

BRIEF DESCRIPTION OF THE DRAWINGS

Exemplary embodiments of the invention are described in more detail hereinbelow and illustrated in the drawing, in which.

DETAILED DESCRIPTION OF THE PRESENTLY PREFERRED EMBODIMENTS

Figure 5:
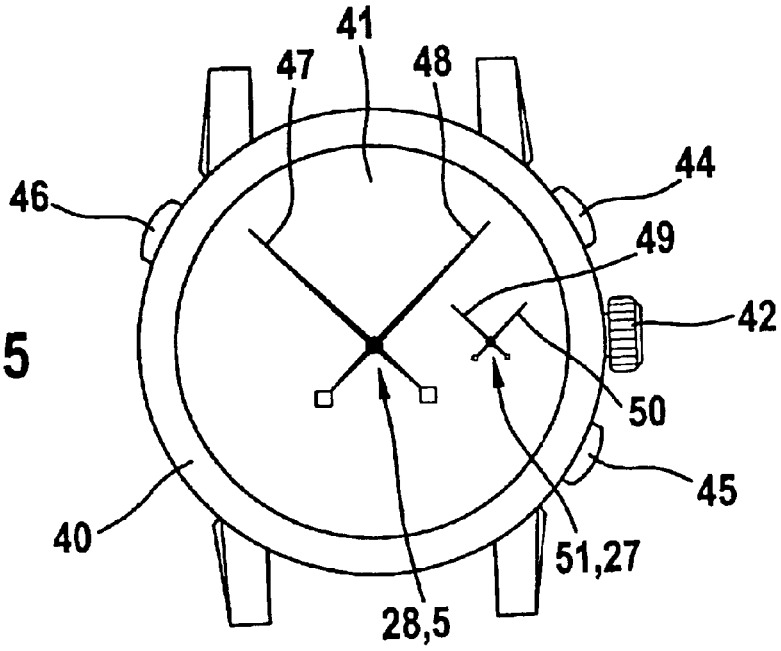
FIG. 5 shows a plan view of a chronograph according to FIG. 1.

The chronograph illustrated in FIG. 5 has a case with a round dial 41. Arranged in the center is a first chronograph-hand stem 28 and a first rattrapante-hand stem 5 of a seconds counter, the first chronograph-hand stem 28 bearing a chronograph hand 47 and the first rattrapante-hand stem 5 bearing a first rattrapante hand 48, which can be driven in an overlapping manner with one another.

Arranged at a distance from the first chronograph-hand stem 28, and parallel thereto, are a second hand stem 51 of a minutes counter, with a second chronograph hand 49, and a second rattrapante-hand stem 27 of a second rattrapante hand 50, which can be driven in an overlapping manner with the second chronograph hand 49.

A crown 42 is located on the case 40 at the three o'clock position.

In addition, in the form of buttons, a first actuating element 44 is located at the two o'clock position, a second actuating element 46 is located at the ten o'clock position and a third actuating element 45 is located at the four o'clock position.

As can be seen in FIGS. 7 to 10, a chrono center wheel 34 is arranged firmly on the tubular first chronograph-hand stem 28 with the first chronograph hand 47, it being possible for said wheel to be driven in rotation by a chronograph drive 33.

Furthermore, a seconds heart cam 29 for resetting the first chronograph hand 47 to a starting or zero position is arranged on the first chronograph-hand stem 28, as is a rattrapante heart cam 30 of a force-fitting coupling, in a rotationally fixed manner.

The first rattrapante-hand stem 5 is mounted in a rotatable manner in the axially continuous bore of the tubular first chronograph-hand stem 28. This first rattrapante-hand stem 5 bears a rattrapante wheel 6 in a rotationally fixed manner, the radially encircling lateral surface 32 of said wheel being-provided with a fine toothing arrangement or roughened texture.

In the radially outer region of the rattrapante wheel 6, a rattrapante-heart-cam lever 35 is articulated, by one end, such that it can be pivoted about a pin 36 which is parallel to the first chronograph-hand stem 28. This rattrapante-heart-cam lever 35 can be pivoted in the same plane as the rattrapante heart cam 30 is located. By means of a tension spring 37, the free end of the rattrapante-heart-cam lever 35 is forced into abutment, by way of a coupling surface 38, against the encircling lateral surface 32 of the rattrapante heart cam 30.

If the rattrapante wheel 6 can be rotated freely, then the rattrapante-heart-cam lever 35 slides along the lateral surface 32 of the rattrapante heart cam 30 until the lateral surface is positioned next to the first chronograph-hand stem 28 and, in this position, the lever 35 couples the rattrapante wheel 6 and first chronograph-band stem 28 to one another in a force-fitting manner.

Figure 9:
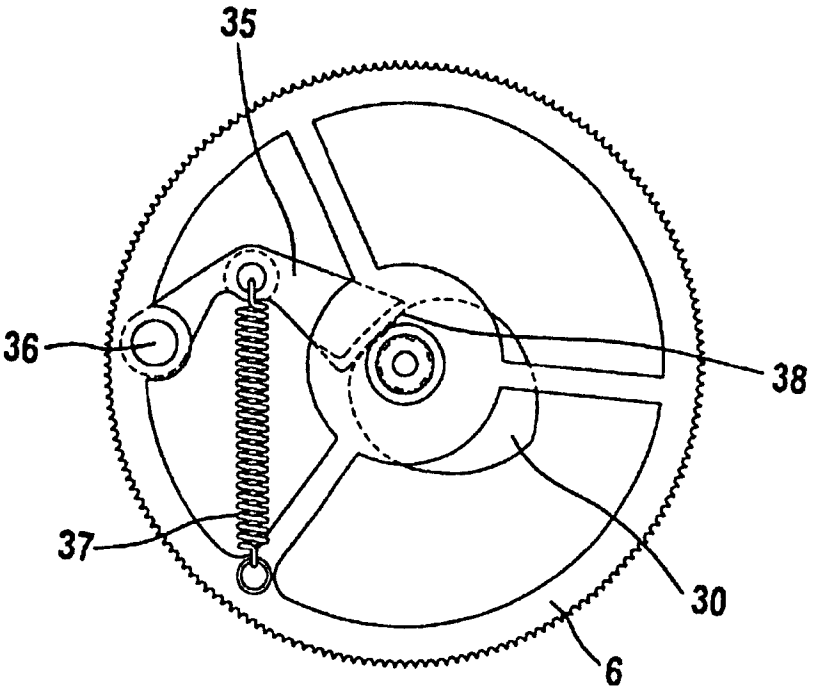
FIG. 9 shows a plan view of a rattrapante wheel and coupling of the chronograph mechanism according to FIG. 7 in the coupled position.

In this position, which is illustrated in FIG. 9, the first chronograph hand 47 and the first rattrapante hand 48 are located in a position in which they overlap one another. When the first chronograph-hand stem 28 is driven in rotation, the rattrapante-hand stem 5 is rotated along synchronously via the force-fitting coupling of the rattrapante-heart-cam lever 35, with the result that the first chronograph hand 47 and the first rattrapante hand 48 move together as if connected to one another.

If, as the first chronograph-hand stem 28 is being driven, the rattrapante wheel 6 blocks, the rattrapante-heart-cam lever 35 slides along the lateral surface of the rattrapante heart cam 30 by way of its coupling surface 38, the tension spring 37 being subjected to stressing in the process, with the result that the first rattrapante hand 48 remains stationary, while the first chronograph hand 47 continues rotating. This can be seen in FIG. 10. When the blocking of the rattrapante wheel 6 is eliminated, the rattrapante-heart-cam lever 35 slides along the lateral surface of the rattrapante heart cam 30 until it is positioned next to the first chronograph-hand stem 28, in order then to continue rotating synchronously with the first chronograph-hand stem 28.

In order to block the rotary movement of the rattrapante wheel 6, the latter is encompassed by the free ends of the gripper arms 1, 1' of an approximately u-shaped first rattrapante gripper 31. On the surfaces which are directed toward the lateral surface 32 of the rattrapante wheel 6, the gripper arms 1, 1' are likewise provided with a fine toothing arrangement or roughened texture, with the result that it is possible to produce a form-fitting connection between the rattrapante wheel 6 and the gripper arms 1 ,1'.

At their end regions which are directed away from the rattrapante wheel 6, the gripper arms 1, 1' are provided with a fastening foot 4, 4' for stationary fastening purposes.

In the region adjoining the fastening foot 4, 4', the gripper arms 1, 1' are designed as a resilient part 3 such that the first rattrapante gripper 31 is positioned against the rattrapante wheel 6 with its gripper arms 1, 1' prestressed resiliently.

On that side of the resilient part 3 which is directed away from the fastening foot 4, 4', V-shaped contact cams 2, 2' which project in a ramp-like manner are formed on the mutually facing inner sides of the gripper arms 1, 1'.

A column wheel 7 is arranged such that it can be rotated about an axis of rotation which intersects the line of symmetry of the first rattrapante gripper 31, parallel to the first chronograph-hand stem 28, said column wheel having four alternately radially projecting columns a, b, c, d and four valleys e, f, g, h of relatively short radial extent distributed uniformly on the circumference, and the contact cams 2, 2', depending on the position of the column wheel 7, come into abutment against the end side of a column a, b, c, d, and lift off the gripper arms 1, 1' from the rattrapante wheel 6, or project into a valley e, f, g, h, with the result that the gripper arms 1, 1' butt, with spring prestressing, against the rattrapante wheel 6 and block the same.

Continued rotation of a sawtooth wheel 18 by a 45° step in the clockwise direction for the purpose of recording time intervals takes place, in a manner which is not illustrated, by actuation of the second actuating element 46, with the result that such a switching step results either in unblocking of the previously blocked rattrapante wheel 6 or in blocking of the previously unblocked rattrapante wheel 6.

Figure 6:
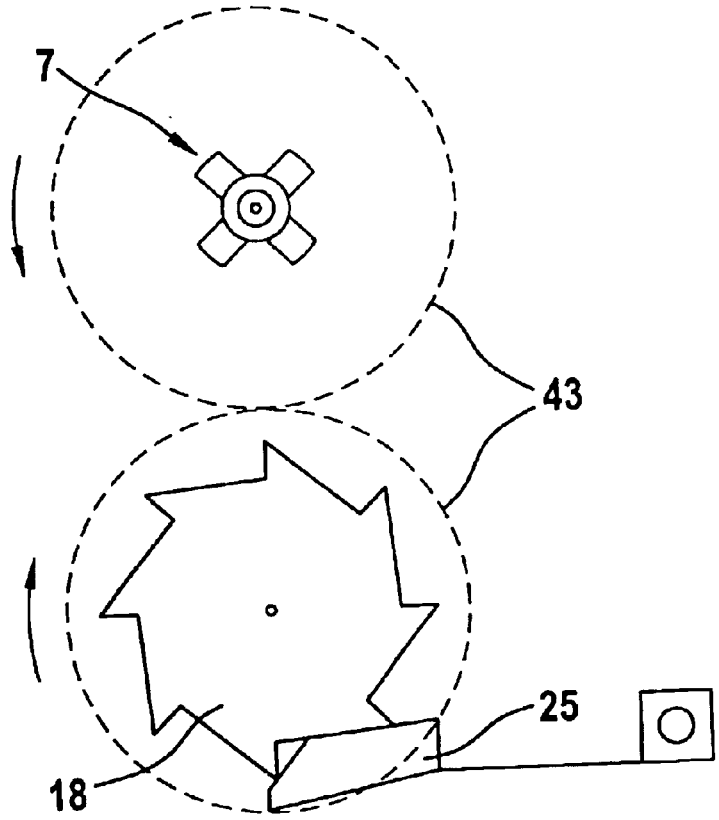
FIG. 6 shows a schematic illustration of a second exemplary embodiment of a rattrapante device.
Figure 8:
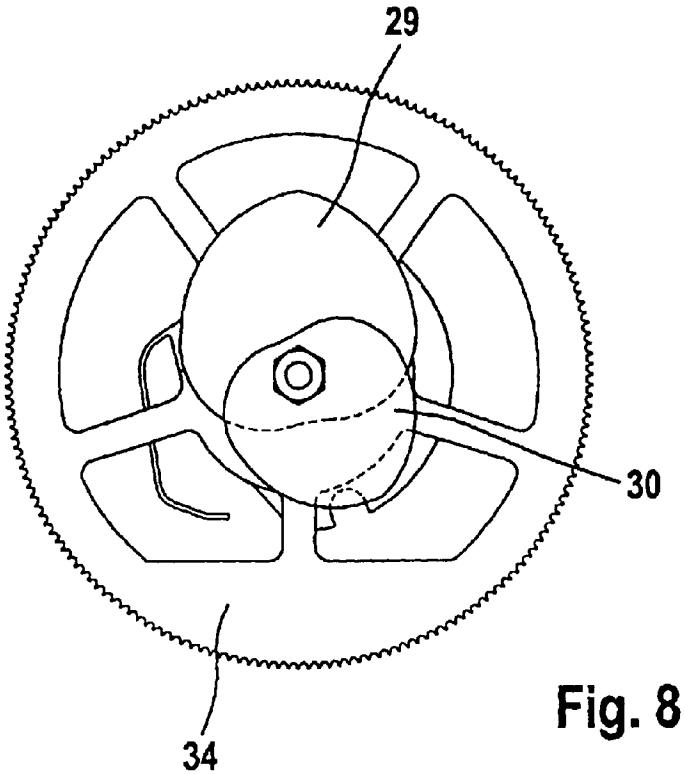
FIG. 8 shows a plan view of a seconds heart cam and rattrapante heart cam and chronograph driving wheel of the chronograph mechanism according to FIG. 7.
Figure 7:
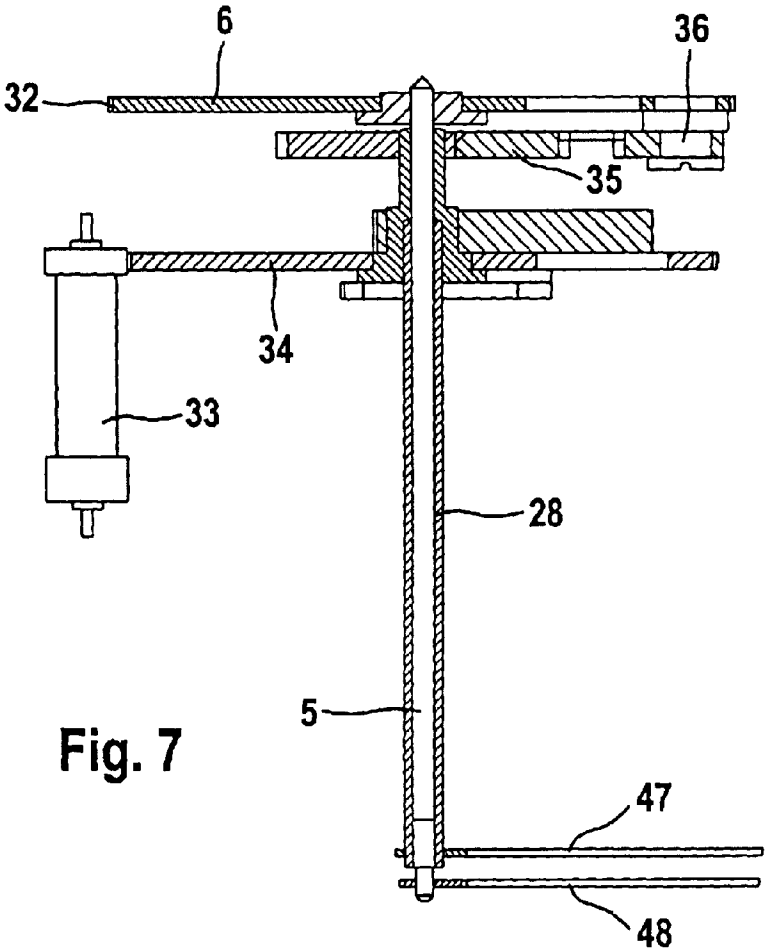
FIG. 7 shows a side view of a chronograph mechanism of a rattrapante device according to FIG. 1.
Figure 10:
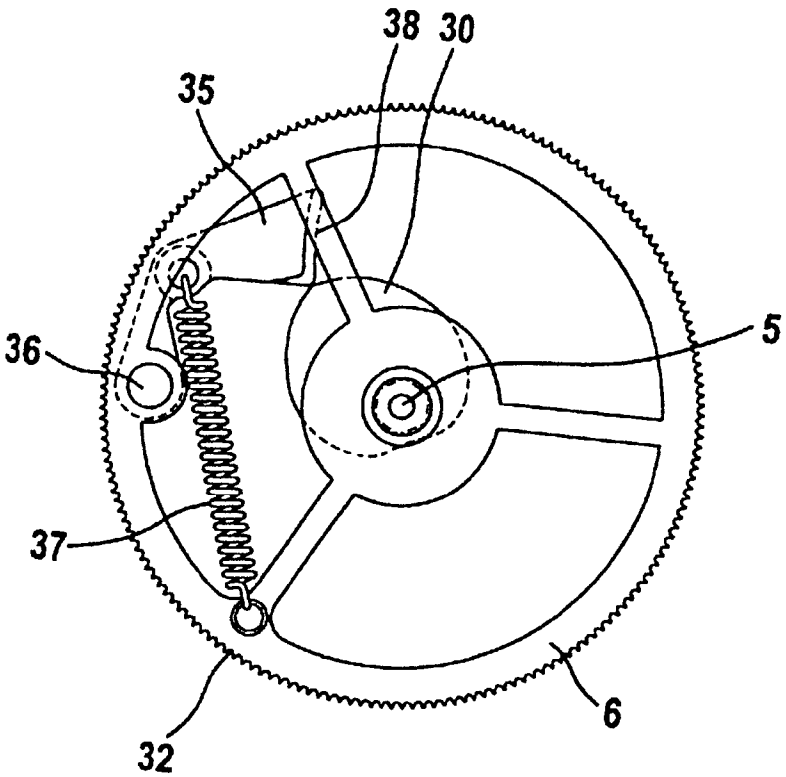
FIG. 10 shows a plan view of the rattrapante wheel and coupling of the chronograph mechanism according to FIG. 7 in the uncoupled position.

Either connected to the column wheel 7 in a coaxially rotationally fixed manner (FIGS. 1 to 4) or connected to the column wheel via an intermediate gear mechanism 43 (FIG. 6), the sawtooth wheel 18 is provided with eight teeth Z1 to Z8 and can also be rotated further by a switching step of 45° in the clockwise direction by way of an adjusting device, by means of the third actuating element 45.

The adjusting device has a lever 19 which can be pivoted about a pivot pin 22, parallel to the axes of rotation of the column wheel 7 and of the sawtooth wheel 18, can be moved, by means of the third actuating element 45, in the direction of its longitudinal extent, approximately tangentially to the sawtooth wheel 18, and has a pawl 24 at its free end.

The lever 19 also has a contact element 23, which butts radially against the column wheel 7 and can be moved in the radial direction by the latter. Depending on the position of the column wheel 7, the contact element 23 comes into abutment against the end side of a column a, b, c, d or projects into a valley e, f, g, h.

Correspondingly, the lever 19 is also pivoted about the pivot pin 22 at that end of the lever 19 which is opposite to the pawl 24.

A further lever 20 also has its end articulated on the pivot pin 22, said lever 20 extending approximately at right angles to the lever 19 and being capable of being pivoted about a stationary pivot pin 21 at its other end.

The third actuating element 45 acts on the lever 20, counter to a spring force, in a direction transverse to its longitudinal extent, with the result that it pivots about the pivot pin 21 and moves the lever 19 approximately in the direction of its longitudinal extent.

If the contact element 23 here is located on the end side of a column a, b, c, d, then the lever 19 is thus pivoted such that the pawl 24 is not located in the region of engagement with the sawtooth wheel 18 and cannot force it to rotate further.

The column wheel 7 thus also remains in its position in which the gripper arms 1, 1' are lifted off from the rattrapante wheel 6 and, by way of this rattrapante wheel 6, the first rattrapante hand 48, which can be driven by the latter, can move together with the first chronograph hand 47 once, by actuation of the third actuating element 45, the two hands 47 and 48 have been moved into the zero position and the activation of the third actuating element 45 has been completed.

Figure 3:
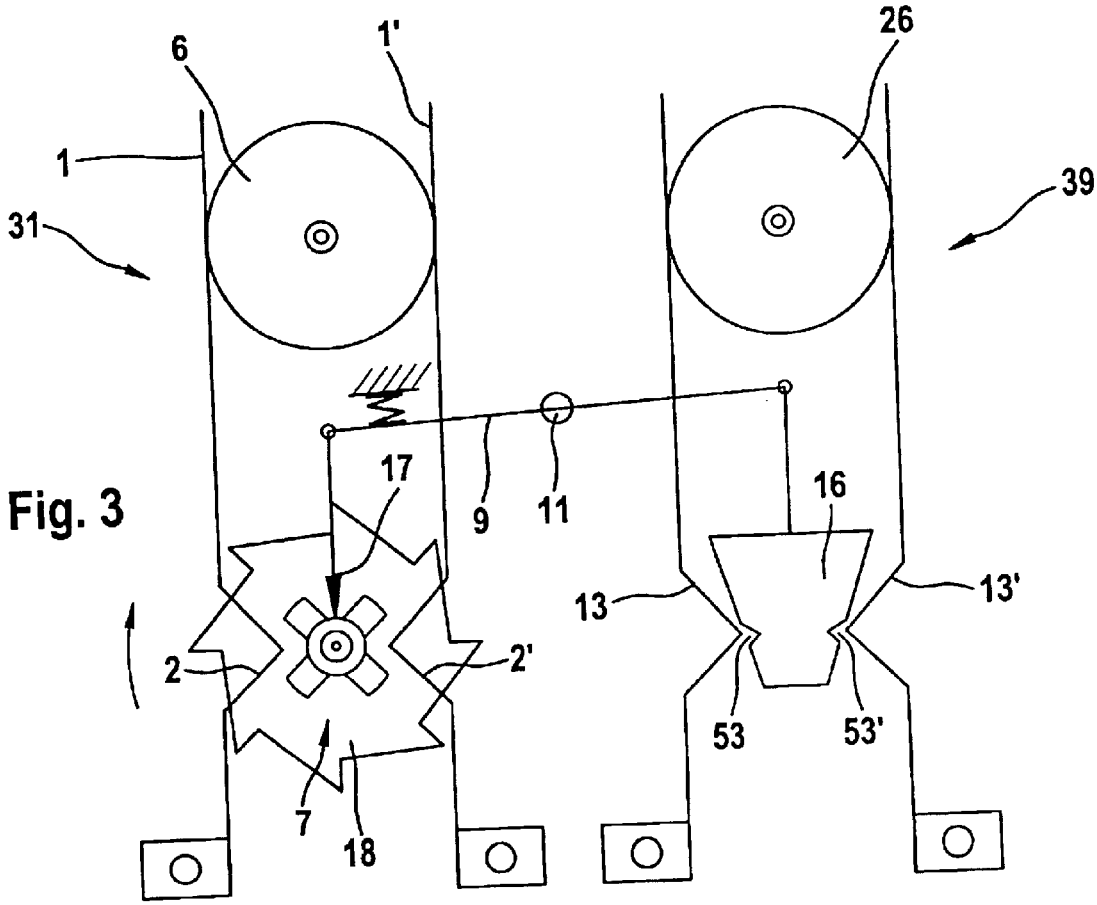
FIG. 3 shows the rattrapante device according to FIG. 1 with the rattrapante grippers closed.
Figure 4:
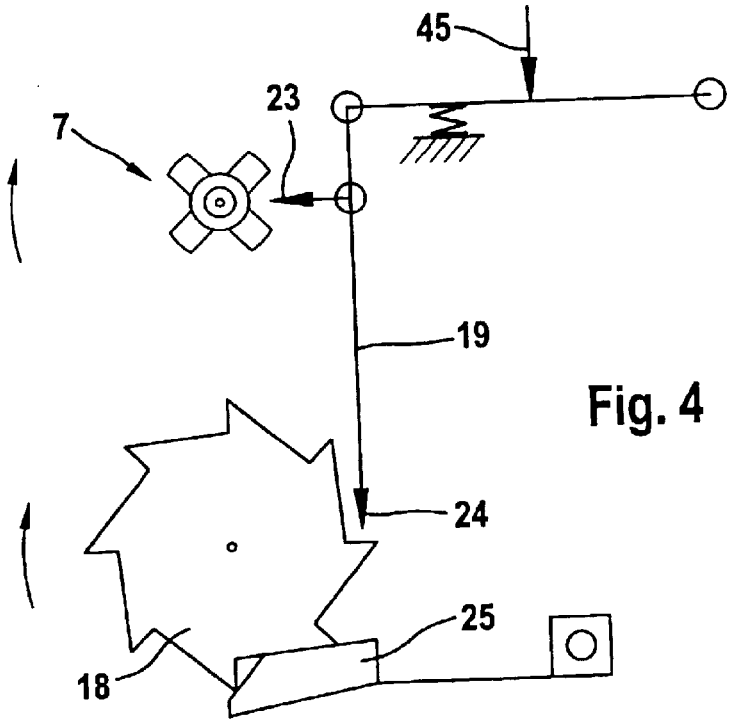
FIG. 4 shows the mechanism according to FIG. 2 and the switching position belonging to the switching position of the rattrapante device according to FIG. 3.

If, however, as is illustrated in FIGS. 3 and 4, the contact element 23 is located in a valley e, f, g, h of the column wheel 7 when the third actuating element 45 is actuated, then the lever 19 is pivoted, by way of its pawl 24, into the region of engagement with the sawtooth wheel 18 and, as a result of the actuation of the said actuating element 45 and the axial movement of the lever 19, rotates the sawtooth wheel 18 further through 45°.

However, the column wheel 7 is thus also rotated further through 45°, with the result that the contact cams 2, 2' reach the end sides of the columns, a, b, c, d and the previously closed first rattrapante gripper 31 lifts off by way of its gripper arms 1, 1' and allows the rattrapante wheel 6 to rotate. The first rattrapante hand 48 thus jumps to the position of the chronograph hand 47.

In order to prevent accidental switching of the sawtooth wheel 18, a latching spring 25 is provided, it being possible for the latter to be latched resiliently into the gaps between the teeth z1 to z8 of the sawtooth wheel 18, as shown in FIG. 4.

By means of the chronograph drive 33, when the first actuating element 44 is actuated manually, the second hand stem 51 of the second chronograph hand 49 can also be driven in rotation, the second rattrapante-hand stem 27 of the second rattrapante hand 50 being arranged coaxially with said second hand stem 51, and it being possible for said second rattrapante hand 50 to be driven in an overlapping manner with the second chronograph hand 49.

In the same manner, although not illustrated in this instance, as for the drive of the first chronograph hand 47 and first rattrapante hand 48, and with the same functioning, a minute-counter heart cam for resetting the second chronograph hand 49 is arranged on the second hand stem 51, and the second hand stem 51 and the second rattrapante-hand stem 27 can be connected to one another in a rotationally fixed manner by a second rattrapante heart cam of a force-fitting coupling.

A second rattrapante wheel 26 is arranged on the second rattrapante-hand stem 27, can be encompassed under spring prestressing by gripper arms 12, 12' of a second rattrapante gripper 39 and can be blocked against rotation by a friction fit.

The second rattrapante gripper 39, with the gripper arms 12 and 12', with contact cams 13 and 13', resilient parts 14 and 14' and fastening feet 15 and 15', has the same construction and the same functioning as the first rattrapante gripper 31.

Arranged between the contact cams 13, 13' in order to activate the same is a ramp element 16 which can be moved approximately in the direction of the longitudinal extent of the gripper arms 12, 12' and by means of which the gripper arms 12, 12' of the second rattrapante gripper 39 can be spread apart from one another and thus lifted off from the rattrapante wheel 26.

The ramp element 16 has in each case one ramp 52, 52', with depressions 53, 53' which are directed toward one another, assigned to a contact cam 13, 13'.

In order to move the ramp element 16, use is made of an actuating device which has a two-armed lever 9 which can be pivoted about a pivot pin 11. A contact nose 17 is arranged at the end of one lever arm of the lever 9 and is able to gage the position of the column wheel 7. The end of the second lever arm of the lever 9 is articulated on the ramp element 16.

If the contact nose 17 is located in a valley e, f, g, h of the column wheel 7, then the lever 16 is pivoted into such a position that the contact cams 13, 13' are located, in the tapered region of the ramp element 16, level with the depressions 53, 53' and are inserted into the latter. It is thus possible for the gripper arms 12, 12' to move toward one another into the rotation-blocking position of the second rattrapante wheel 26 (FIG. 3).

If, by virtue of the column wheel 7 being rotated, the contact nose 17 is lifted out of a valley e, f, g, h of the column wheel 7 onto the end side of a column a, b, c, d, the lever 19 is pivoted as a result.

Figure 1:
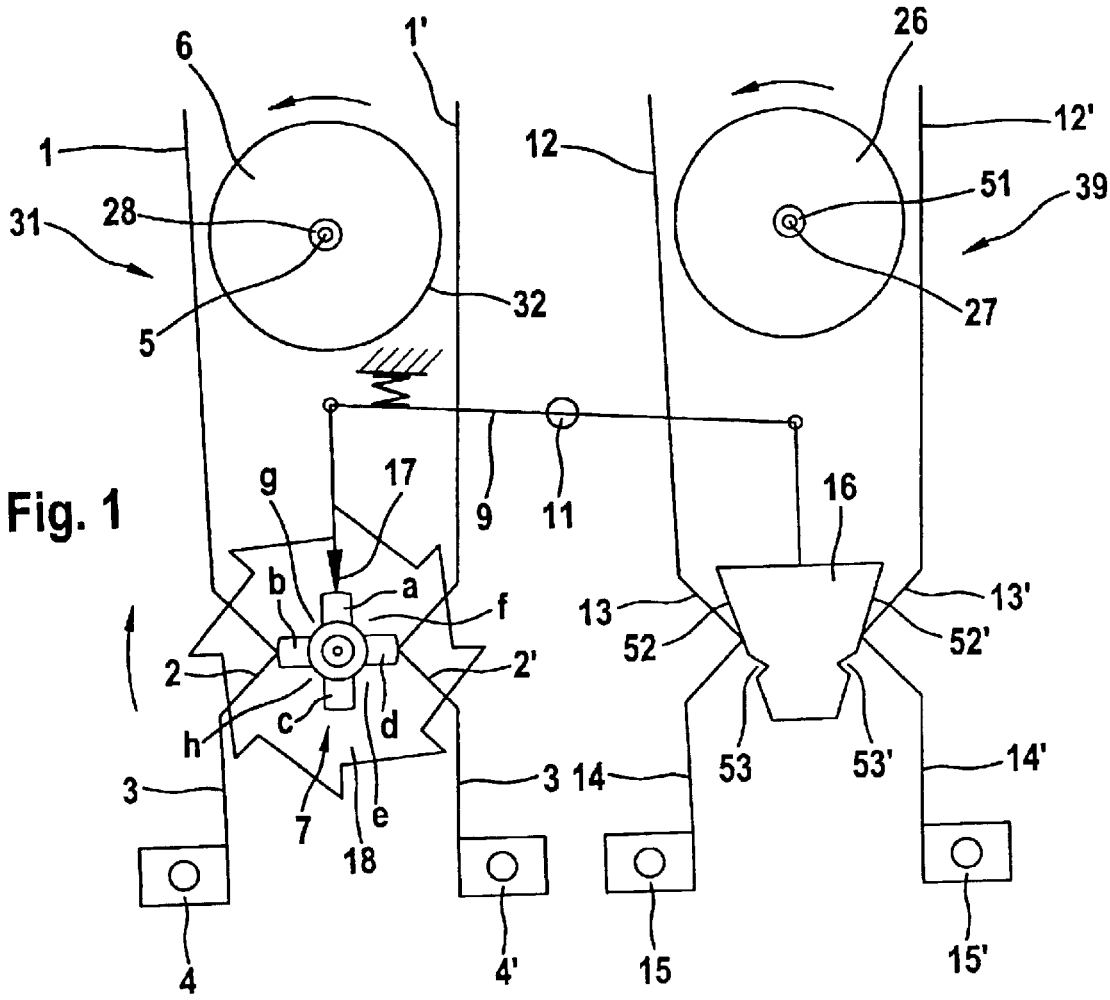
FIG. 1 shows a schematic illustration of a rattrapante device of a chronograph for recording time periods in seconds and minutes, with the rattrapante grippers open.
Figure 2:
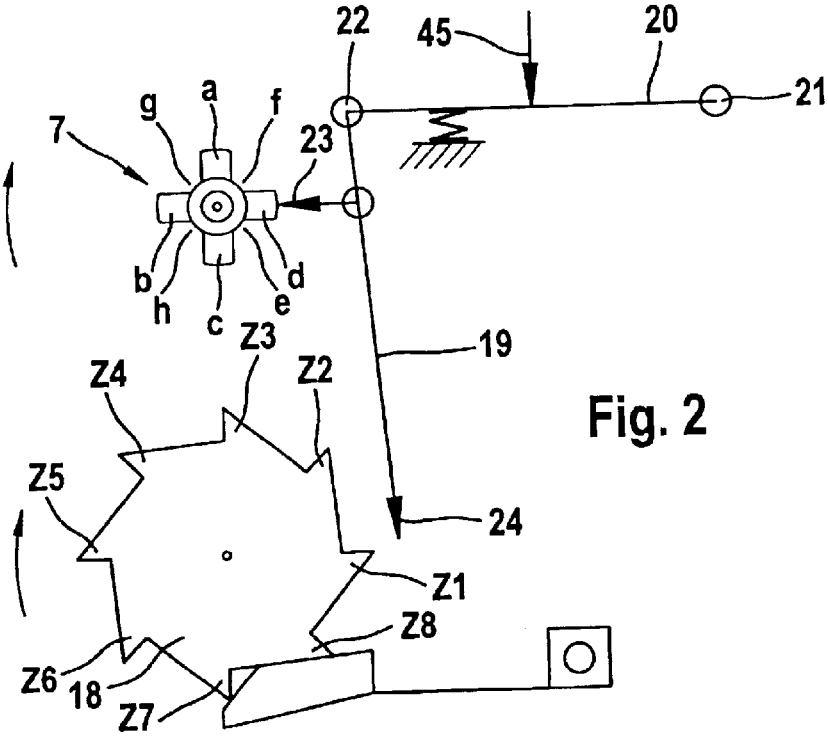
FIG. 2 shows a supplementary schematic illustration of the mechanism of the rattrapante device according to FIG. 1 which can be actuated by the third switching element.

The ramp element 16 thus also moves, however, and the ramps 52, 52' act on the contact cams 13, 13' such that the gripper arms 12, 12' of the second rattrapante gripper 39 are spread apart from one another and lift off from the second rattrapante wheel 26, out of their rotation-blocking position (FIG. 1).

What is claimed is:

1. A chronograph comprising:

a chronograph hand stem which can be driven in rotation when a first actuating element is actuated manually, said chronograph hand stem carrying a chronograph hand, a seconds heart cam arranged on the chronograph hand stem for resetting the chronograph hand, a rattrapante hand stem, coaxial with the chronograph hand stem, carrying a rattrapante hand overlapping the chronograph hand, a rattrapante heart cam which can connect the chronograph hand stem to the rattrapante hand stem in a rotationally fixed manner, a rattrapante gripper having prestressed gripper arms which can grip a rattrapante wheel fixed on the rattrapante hand stem to block said rattrapante wheel against rotation, a switching element which can be rotated between a blocking position and an unblocking position when a second actuating element is actuated manually, said gripper arms being lifted from the rattrapante wheel so that said rattrapante wheel can rotate when said switching element is in said unblocking position, and a third actuating element which, when moved manually from an inactive position to an active position, causes said chronograph hand stem and said chronograph hand to be moved into their zero position, and causes said switching element in its blocking position to move into its unblocking position, and causes said switching element in its unblocking position to remain in its unblocking position.

2. A chronograph as in claim 1 further comprising an adjusting device by means of which the switching element can be driven to move between said blocking position and said unblocking position, said adjusting device being actuated by means of said third actuating element; and a contact element which gages the position of the switching element and, in the unblocking position, deactivates the adjusting device and, in the blocking position, activates the adjusting device.

3. A chronograph as claimed in claim 2 wherein said adjusting element comprises a switching wheel which is arranged to rotate with said switching element, and a switching nose which can be actuated by said third actuating element to advance said switching wheel when said switching element is moved from said blocking position to said unblocking position.

4. A chronograph as in claim 3 wherein said switching wheel is one of a sawtooth wheel and a cam wheel, and said switching nose is a pawl which can engage the switching wheel in the blocking position of the switching element and can disengage the switching wheel in the unblocking position of the switching element.

5. A chronograph as in claim 4 wherein said switching wheel is a column wheel comprising a plurality of radially projecting columns alternating with a like plurality of valleys, said adjusting device comprising a contact element which is radially movable to abut against one of said columns or to project into one of said valleys.

6. A chronograph as in claim 5 wherein said adjusting device comprises a lever which can pivot about a pivot pin parallel to the axes of rotation of the column wheel and the switching wheel, said lever having a free end with said pawl and being movable approximately tangentially to said switching wheel and being pivotable so that said pawl disengages said switching wheel when said contact element abuts against one of said columns.

7. A chronograph as in claim 6 wherein said lever pivots so that said pawl disengages said switching wheel when said contact element abuts against one of said columns.

8. A chronograph as in claim 5 wherein said gripper arms have respective contact cams which are directed radially with respect to the axis of rotation of the column wheel and, depending on the position of the column wheel, butt against a radially opposed pair of said columns or project into a radially opposed pair of said valleys.

9. A chronograph as in claim 3 further comprising a latching spring which acts on at least one of said switching element and said switching wheel to arrest said switching element in said blocking position.

10. A chronograph as in claim 9 wherein said switching wheel comprises teeth having gaps therebetween, said latching spring engaging in said gaps.

11. A chronograph as in claim 2 wherein said switching element can be advanced in either of two directions of rotation.

12. A chronograph as in claim 1 wherein said adjusting device is disengaged from the switching wheel in the unblocking position of the switching element.

13. A chronograph as in claim 1 further comprising a spring which urges said third actuating element toward said inactive position.

14. A chronograph as in claim 1 wherein said rattrapante wheel is a rattrapante wheel of a seconds counter.

15. A chronograph as in claim 1 further comprising:

a second hand stem which can be driven in rotation when said first actuating element is actuated manually, said second hand stem carrying a second chronograph hand, a minutes counter heart cam arranged on the second hand stem for resetting the second chronograph hand, a second rattrapante hand stem, coaxial with the second hand stem, carrying a second rattrapante hand overlapping the second chronograph hand, a second rattrapante heart cam which can connect the second hand stem to the second rattrapante hand stem in a rotationally fixed manner, and a second rattrapante gripper having prestressed gripper arms which can grip a second rattrapante wheel fixed on the second rattrapante hand stem to block said second rattrapante wheel against rotation, said gripper arms of said second rattrapante gripper being lifted off the second rattrapante wheel so that said second rattrapante wheel can rotate when said switching element is in said unblocking position, said second hand stem and said second chronograph hand being moved into their zero position, and said second rattrapante hand stem and said second rattrapante hand being moved into their zero position, when said third actuating element is moved manually from said inactive position to said active position.

16. A chronograph as in claim 15 wherein said second rattrapante wheel is the rattrapante wheel of a minutes counter and the second rattrapante hand is a rattrapante minutes counter.

17. A chronograph as in claim 15 wherein said chronograph hand stem and said second hand stem can be driven in rotation by a common chronograph drive.

18. A chronograph as in claim 15 further comprising an adjusting device which is actuated by said switching element to lift said gripper arms of the second rattrapante gripper from the second rattrapante wheel so that said second rattrapante wheel can rotate.

19. A chronograph as in claim 18 further comprising a second switching element for lifting the gripper arms of the second rattrapante gripper from the second rattrapante wheel, said adjusting device comprising a lever which can be pivoted about a pivot pin and having a first lever arm and a second lever arm extending oppositely from said pivot pin, and a contact nose arranged on said first lever arm for gaging the position of said switching element, said second lever arm actuating said second switching element to lift the gripper arms of the second rattrapante gripper from the second rattrapante wheel when said switching element is in said blocking position.

20. A chronograph as in claim 19 wherein said second switching element comprises a wedge element which can be moved, by means of the second lever arm, between the gripper arms of the second rattrapante gripper so that said arms move away from each other.

* * * * *